US007673365B1

(12) United States Patent
Griffin, Sr.

(10) Patent No.: US 7,673,365 B1
(45) Date of Patent: Mar. 9, 2010

(54) ADJUSTABLE TOOL FOR FINISHING CONCRETE SURFACES

(76) Inventor: Douglas A. Griffin, Sr., 20022 Sawmill Rd., Georgetown, DE (US) 19947

( * ) Notice: Subject to any disclaimer, the term of this patent is extended or adjusted under 35 U.S.C. 154(b) by 1371 days.

(21) Appl. No.: 11/099,890

(22) Filed: Apr. 7, 2005

(51) Int. Cl.
*E01C 19/12* (2006.01)

(52) U.S. Cl. ..... 15/235.8; 15/244.2; 15/144.1; 15/144.4

(58) Field of Classification Search ..... 15/144.1, 15/144.4, 235.4, 235.8, 244.2, 244.3; 404/118; 425/458

See application file for complete search history.

(56) References Cited

U.S. PATENT DOCUMENTS 4,524,484 A * 6/1985 Graham ..... 16/429
D324,980 S 3/1992 Owens
5,115,536 A 5/1992 Jarvis
5,606,761 A * 3/1997 Lynch ..... 15/144.4
5,687,448 A * 11/1997 Dye, Jr. ..... 15/235.8
5,758,769 A * 6/1998 Vasudeva ..... 206/372
6,032,321 A 3/2000 Shirey et al.
6,189,222 B1 2/2001 Doyle
6,227,750 B1 5/2001 Maggio et al.
6,412,138 B1 7/2002 MacMillan
6,546,596 B2 * 4/2003 Grote et al. ..... 16/429
6,823,555 B2 * 11/2004 Warren ..... 15/176.2

* cited by examiner

*Primary Examiner*—Dung Van Nguyen

(57) ABSTRACT

A tool assembly includes a handle section including operably connected linear sections. A proximal section has a handle portion and a distal section has a fixed longitudinal length protruding away from the proximal section. A float is included having planar top and bottom surfaces. The assembly also includes mechanisms for pivotally connecting the float to the handle section, for pivotally attaching the proximal section to the distal section, and for rotatably connecting the proximal section to the distal section. A mechanism is also included for telescopically adjusting a length of the proximal section. A carrying case is included for housing the float and the handle section therein, and is provided with an articulated lid attached thereto. The pivotally connecting mechanism, the pivotally attaching mechanism, the rotatably connecting mechanism, and the telescopically adjusting mechanism are independently and simultaneously operable.

13 Claims, 2 Drawing Sheets

ADJUSTABLE TOOL FOR FINISHING CONCRETE SURFACES

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tools and, more particularly, to an adjustable tool for finishing concrete surfaces.

2. Prior Art

It has been well known in the art that many problems and difficulties are encountered in providing a simple and easy means for establishing a level and smooth finish to large slabs of concrete. It is desired that the fine particles of sand and concrete be brought to the surface and that the larger particles, e.g., rocks and/or gravel, distribute themselves through the lower regions of the concrete.

In the field of concrete construction and finishing, an apparatus termed a concrete float is attached to a handle to enable the operator to apply the float to areas being serviced by the float. To adapt the apparatus to various use situations, various lengths of handles are needed to work with, for example, a variety of heights of concrete walls. In addition, the float must be set in a range of angles with respect to the long axis of the handle. The conventional apparatus comprises a fixed length handle with the float attached at a fixed angle at the other end of the handle. It would be advantageous to have a float head that is pivotal along a variety of angles.

When a variety of lengths of handles is required, it is necessary to have a large number of floats, each attached to a specific length handle. The use of multiple floats, each with a different length handle attached thereto, is not generally acceptable because of the cost associated therewith. An adjustable handle would alleviate this problem Accordingly, a need remains for an adjustable tool for finishing concrete surfaces. The present invention satisfies such a need by providing an adjustable tool that is easily operated, convenient to use, efficient, and provides an improved level of precision. Such an adjustable surface finishing tool provides a smoother and more consistent surface than alternate tools currently used for this purpose. This results in a better looking finish, produced in a shorter amount of time. This allows for more such finishing tasks to be performed, resulting in increased profits.

BRIEF SUMMARY OF THE INVENTION

In view of the foregoing background, it is therefore an object of the present invention to provide an adjustable tool for finishing concrete surfaces. These and other objects, features, and advantages of the invention are provided by a hand-operable tool assembly for assisting an operator to evenly finish a concrete surface.

The tool assembly includes an elongated handle section including a plurality of operably connected linear sections. A proximal one of the linear sections has a handle portion integrally formed therewith and a distal one of the linear sections has a fixed longitudinal length protruding distally away from the proximal linear section. Such a proximal linear section preferably includes a male member and a female member slidably connected thereto. A float is included having substantially planar top and bottom surfaces and is further slidably engageable across the concrete surface during operating conditions.

The present invention also includes a mechanism for pivotally connecting the float to the handle section such that the float can advantageously be selectively pivoted along a first arcuate plane. The pivotally connecting mechanism preferably includes a bracket that has a bottom portion secured to the top surface of the float via a plurality of fasteners. Such a bracket further has an upper portion integrally connected to the bottom portion and disposed substantially orthogonal thereto. A U-shaped bracket and a pin are positioned attached to the upper bracket portion such that the float can effectively be adapted between substantially parallel and perpendicular positions offset from the handle section.

A mechanism is included for pivotally attaching the proximal linear section to the distal linear section such that the proximal and distal linear section can effectively be selectively pivoted along a second arcuate plane. Such a pivotally attaching mechanism preferably includes a generally U-shaped bracket attached to the proximal linear section. An anchor bracket is connected to the distal linear section and a pin is positioned through the U-shaped bracket and the anchor bracket respectively such that the proximal and distal linear sections can be juxtaposed end-to-end.

The assembly further includes a mechanism for rotatably connecting the proximal linear section to the distal linear section such that the proximal linear section can be selectively rotated along a radial path. Such a rotating attaching mechanism preferably includes an end cap rotatably attached to the distal linear section.

A mechanism is also included for telescopically adjusting a length of the proximal linear section. The telescopically adjusting mechanism includes a rotatable turn knob and a coupling fitted about the male and female members such that the operator can selectively adjust the length of the proximal linear section as needed.

The pivotally connecting mechanism, the pivotally attaching mechanism, the rotatably connecting mechanism, and the telescopically adjusting mechanism are advantageously independently and simultaneously operable as desired by the operator.

The assembly further includes a carrying case sized and shaped for conveniently housing the float and the handle section therein during non-operating conditions. Such a carrying case is provided with an articulated lid attached thereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
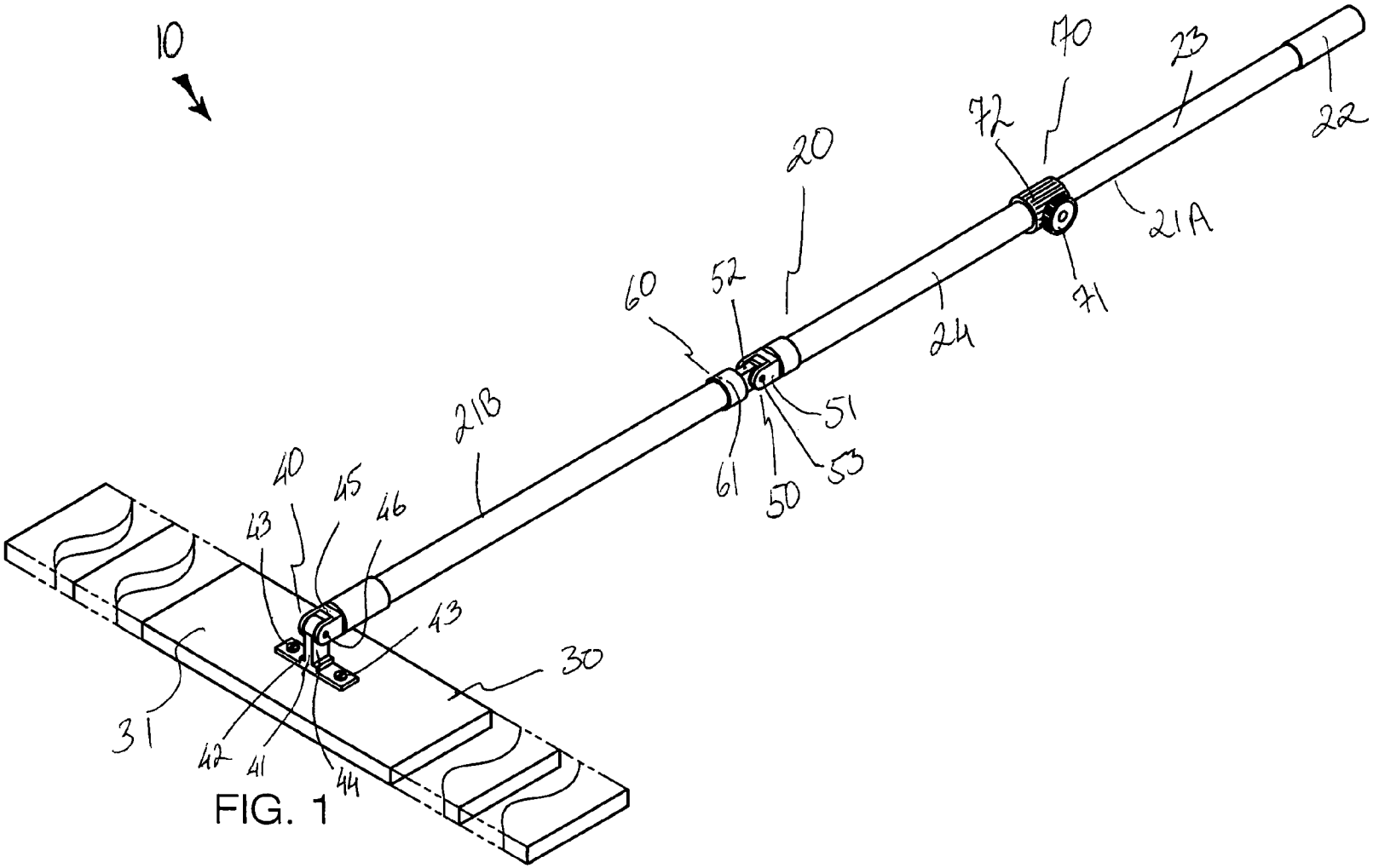
FIG. 1 is a perspective view showing an adjustable tool for finishing concrete surfaces, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide an adjustable tool for finishing concrete surfaces. It should be understood that the assembly 10 may be used to smooth and finish many different types of surfaces and should not be limited in use to only concrete surfaces.

Referring initially to FIG. 1, the assembly 10 includes an elongated handle section 20 including a plurality of operably connected linear sections 21. A proximal one 21A of the linear sections 21 has a handle portion 22 integrally formed therewith and a distal one 21B of the linear sections 21 has a fixed longitudinal length protruding distally away from the proximal linear section 21A. Such a proximal linear section 21A includes a male member 23 and a female member 24 slidably connected thereto. A float 30 having substantially planar top 31 and bottom 32 surfaces is included and is slidably engageable across the concrete surface during operating conditions. Of course, such a float 30 may be produced in a variety of different sizes as is obvious to an individual skilled in the art.

Figure 2:
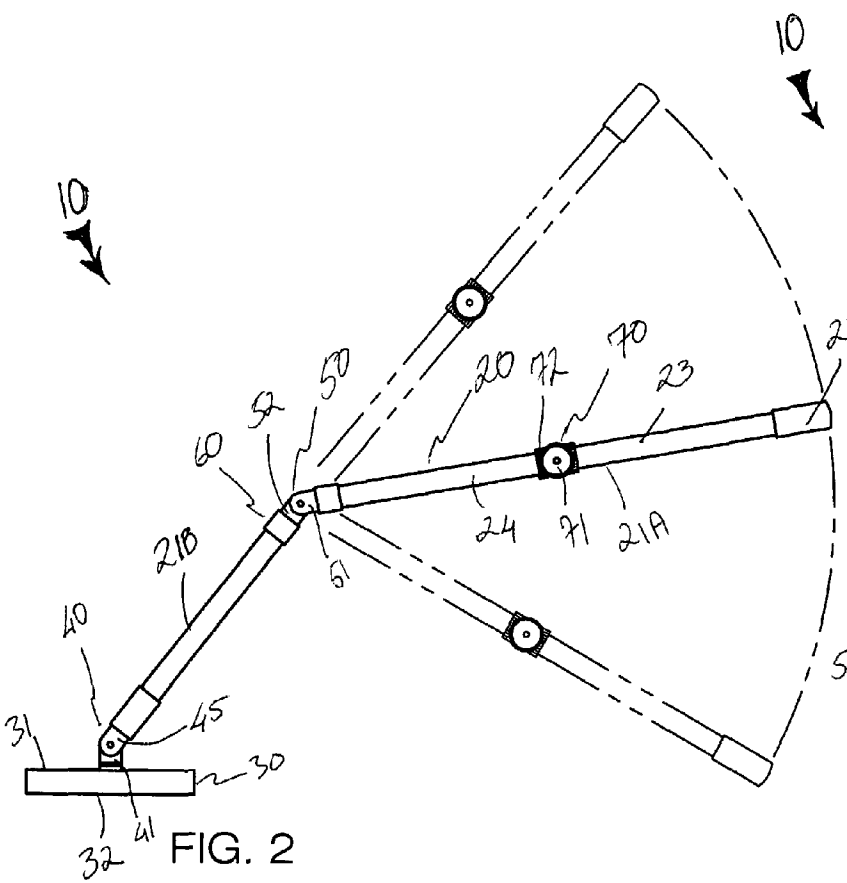
FIG. 2 is a side elevational view of the assembly shown in FIG. 1, showing the pivotal movement of the elongated handle section.

Referring to FIGS. 1 and 2, the present invention also includes a mechanism 40 for pivotally connecting the float 30 to the handle section 20 such that the float 30 can advantageously be selectively pivoted along a first arcuate plane. The pivotally connecting mechanism 40 includes a bracket 41 that has a bottom portion 42 secured to the top surface 31 of the float 30 via a plurality of fasteners 43. Such a bracket 41 further has an upper portion 44 integrally connected to the bottom portion 42 and disposed substantially orthogonal thereto. A U-shaped bracket 45 and a pin 46 are attached to the upper bracket portion 44 such that the float 30 can effectively be adapted between substantially parallel and perpendicular positions offset from the handle section 20. This advantageously allows the float 30 to be used on angled surfaces which is not possible with other finishing tools, such as shovels, currently being used.

Figure 3:
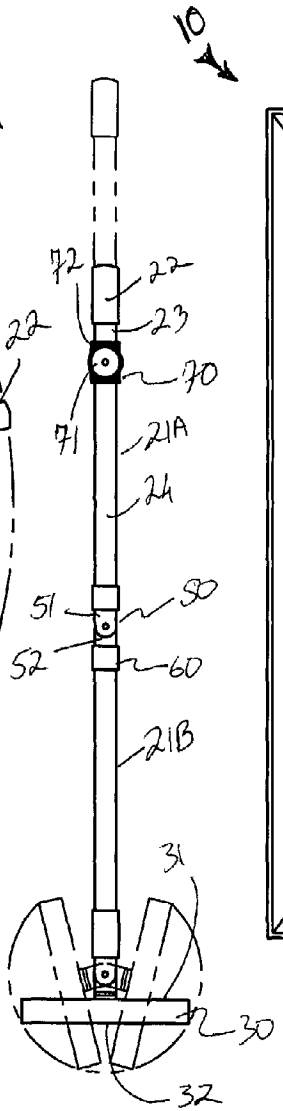
FIG. 3 is a side elevational view of the assembly shown in FIG. 1, showing the adjustable length of the handle section and the pivotal movement of the float.

Referring to FIGS. 1 through 3, a mechanism 50 is included for pivotally attaching the proximal linear section 21A to the distal linear section 21B such that the proximal 21A and distal 21B linear sections can effectively be selectively pivoted along a second arcuate plane. Such a pivotally attaching mechanism 50 includes a generally U-shaped bracket 51 attached to the proximal linear section 21A, an anchor bracket 52 connected to the distal linear section 21B, and a pin 53 positioned through the U-shaped bracket 51 and the anchor bracket 52 respectively such that the proximal 21A and distal 21B linear sections can be juxtaposed end-to-end.

Still referring to FIGS. 1 through 3, the assembly 10 further includes a mechanism 60 for rotatably connecting the proximal linear section 21A to the distal linear section 21B such that the proximal linear section 21A can be selectively rotated along a radial path. Such a rotating attaching mechanism 60 includes an end cap 61 rotatably attached to the distal linear section 21B. This feature allows the sections 21A/21B to rotate freely, thus allowing the float 30 to be moved across the concrete surface with a smooth motion, advantageously giving the concrete surface finish a professional appearance.

Still referring to FIGS. 1 through 3, a mechanism 70 is also included for telescopically adjusting a length of the proximal linear section 21A. The telescopically adjusting mechanism 70 includes a rotatable turn knob 71 and a coupling 72 fitted about the male 23 and female 24 members such that the operator can selectively adjust the length of the proximal linear section 21A as needed. Such an adjustable handle section 20 conveniently eliminates the need to acquire many finishing tools with different handle section lengths, which can be quite costly and impractical. The adjusting mechanism 70 further allows the handle section 20 of assembly 10 to be extended and applied as a ceiling finishing tool, thus greatly increasing the versatility and usefulness thereof.

The pivotally connecting mechanism 40, the pivotally attaching mechanism 50, the rotatably connecting mechanism 60, and the telescopically adjusting mechanism 70 are advantageously independently and simultaneously operable as desired by the operator. This feature advantageously allows the assembly 10 to be adapted to a plethora of different configurations, further improving the versatility and usefulness thereof.

Figure 4:
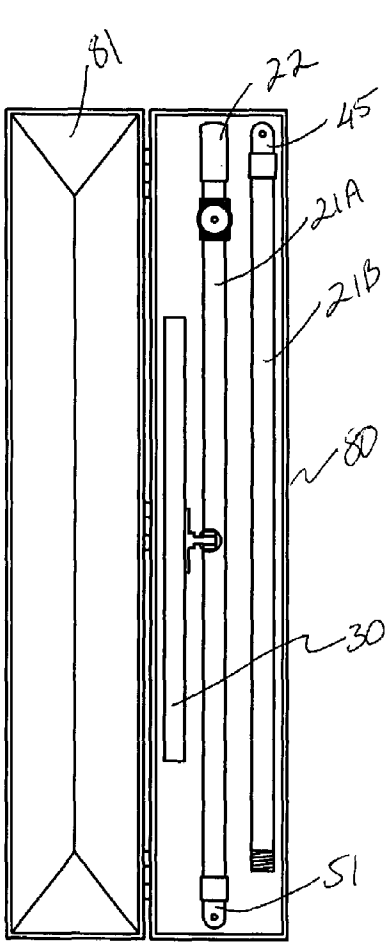
FIG. 4 is a top plan view showing the assembly stored in the carrying case.

Referring to FIG. 4, the assembly 10 further includes a carrying case 80 sized and shaped for conveniently housing the float 30 and the handle section 20 therein during non-operating conditions. Such a carrying case 80 is provided with an articulated lid 81 attached thereto so that the float 30 and handle section 20 can be stored in the case 80, advantageously ensuring that the float 30 or the handle sections 21A/21B are not lost or misplaced.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hand-operable tool for assisting an operator to evenly finish a concrete surface, said tool comprising:

an elongated handle section comprising a plurality of operably connected linear sections, a proximal one of said linear sections having a handle portion integrally formed therewith, a distal one of said linear sections having a fixed longitudinal length protruding distally away from said proximal linear section;

a float having substantially planar top and bottom surfaces and being slidably engageable across the concrete surface during operating conditions;

means for pivotally connecting said float to said handle section such that said float can be selectively pivoted along a first arcuate plane;

means for pivotally attaching said proximal linear section to said distal linear section such that said proximal and distal linear section can be selectively pivoted along a second arcuate plane;

means for rotatably connecting said proximal linear section to said distal linear section such that said proximal linear section can be selectively rotated along a radial path; and means for telescopically adjusting a length of said proximal linear section;

wherein said pivotally connecting means and said pivotally attaching means and said rotatably connecting means and said telescopically adjusting means are independently and simultaneously operable as desired by the operator.

2. The tool of claim 1, wherein said pivotally connecting means comprises:

a bracket having a bottom portion secured to said top surface of said float via a plurality of fasteners, said bracket further having an upper portion integrally connected to said bottom portion and disposed substantially orthogonal thereto;

a U-shaped bracket and a pin positioned attached to said upper bracket portion such that said float can be adapted between substantially parallel and perpendicular positions offset from said handle section.

3. The tool of claim 1, wherein said pivotally attaching means comprises:

a generally U-shaped bracket attached to said proximal linear section;

an anchor bracket connected to said distal linear section; and a pin positioned through said U-shaped bracket and said anchor bracket respectively such that said proximal and distal linear sections can be juxtaposed end-to-end.

4. The tool of claim 1, wherein said rotating attaching means comprises:

an end cap rotatably attached to said distal linear section.

5. The tool of claim 1, wherein said proximal linear section comprises:

a male member and a female member slidably connected thereto;

said telescopically adjusting means comprising a rotatable turn knob and a coupling fitted about said male and female members such that the operator can selectively adjust the length of said proximal linear section as needed.

6. A hand-operable tool for assisting an operator to evenly finish a concrete surface, said tool comprising:

an elongated handle section comprising a plurality of operably connected linear sections, a proximal one of said linear sections having a handle portion integrally formed therewith, a distal one of said linear sections having a fixed longitudinal length protruding distally away from said proximal linear section;

a float having substantially planar top and bottom surfaces and being slidably engageable across the concrete surface during operating conditions;

means for pivotally connecting said float to said handle section such that said float can be selectively pivoted along a first arcuate plane;

means for pivotally attaching said proximal linear section to said distal linear section such that said proximal and distal linear section can be selectively pivoted along a second arcuate plane;

means for rotatably connecting said proximal linear section to said distal linear section such that said proximal linear section can be selectively rotated along a radial path;

means for telescopically adjusting a length of said proximal linear section; and a carrying case sized and shaped for housing said float and said handle section therein during non-operating conditions;

wherein said pivotally connecting means and said pivotally attaching means and said rotatably connecting means and said telescopically adjusting means are independently and simultaneously operable as desired by the operator.

7. The tool of claim 6, wherein said pivotally connecting means comprises:

a bracket having a bottom portion secured to said top surface of said float via a plurality of fasteners, said bracket further having an upper portion integrally connected to said bottom portion and disposed substantially orthogonal thereto;

a U-shaped bracket and a pin positioned attached to said upper bracket portion such that said float can be adapted between substantially parallel and perpendicular positions offset from said handle section.

8. The tool of claim 6, wherein said pivotally attaching means comprises:

a generally U-shaped bracket attached to said proximal linear section;

an anchor bracket connected to said distal linear section; and a pin positioned through said U-shaped bracket and said anchor bracket respectively such that said proximal and distal linear sections can be juxtaposed end-to-end.

9. The tool of claim 6, wherein said rotating attaching means comprises:

an end cap rotatably attached to said distal linear section.

10. The tool of claim 6, wherein said proximal linear section comprises:

a male member and a female member slidably connected thereto;

said telescopically adjusting means comprising a rotatable turn knob and a coupling fitted about said male and female members such that the operator can selectively adjust the length of said proximal linear section as needed.

11. A hand-operable tool assembly for assisting an operator to evenly finish a concrete surface, said tool assembly comprising:

an elongated handle section comprising a plurality of operably connected linear sections, a proximal one of said linear sections having a handle portion integrally formed therewith, a distal one of said linear sections having a fixed longitudinal length protruding distally away from said proximal linear section;

a float having substantially planar top and bottom surfaces and being slidably engageable across the concrete surface during operating conditions;

means for pivotally connecting said float to said handle section such that said float can be selectively pivoted along a first arcuate plane;

means for pivotally attaching said proximal linear section to said distal linear section such that said proximal and distal linear section can be selectively pivoted along a second arcuate plane;

means for rotatably connecting said proximal linear section to said distal linear section such that said proximal linear section can be selectively rotated along a radial path;

means for telescopically adjusting a length of said proximal linear section; and a carrying case sized and shaped for housing said float and said handle section therein during non-operating conditions, said carrying case being provided with an articulated lid attached thereto;

wherein said pivotally connecting means and said pivotally attaching means and said rotatably connecting means and said telescopically adjusting means are independently and simultaneously operable as desired by the operator, wherein said pivotally connecting means comprises:

a bracket having a bottom portion directly secured to said top surface of said float via a plurality of fasteners, said bracket further having an upper portion integrally connected to said bottom portion and disposed substantially orthogonal thereto; a U-shaped bracket and a pin directly attached to said upper bracket portion such that said float can be adapted between substantially parallel and perpendicular positions offset from said handle section;

wherein said pivotally attaching means comprises:

a generally U-shaped bracket directly attached to said proximal linear section;

an anchor bracket directly connected to said distal linear section; and a pin directly positioned through said U-shaped bracket and said anchor bracket respectively such that said proximal and distal linear sections are juxtaposed end-to-end.

12. The tool assembly of claim 11, wherein said rotating attaching means comprises:

an end cap rotatably attached to said distal linear section.

13. The tool assembly of claim 11, wherein said proximal linear section comprises:

a male member and a female member slidably connected thereto;

said telescopically adjusting means comprising a rotatable turn knob and a coupling fitted about said male and female members such that the operator can selectively adjust the length of said proximal linear section as needed.

* * * * *